US005851068A

United States Patent [19]

Rumph

[11] Patent Number: 5,851,068

[45] Date of Patent: Dec. 22, 1998

[54] INTERMODAL TRANSPORTATION OF SEDIMENTARY SUBSTANCES

[75] Inventor: Robert M. Rumph, Sumter, S.C.

[73] Assignee: The Maitland Co., Sumter, S.C.

[21] Appl. No.: 850,148

[22] Filed: May 2, 1997

Related U.S. Application Data

[63] Continuation-in-part of Ser. No. 378,799, Jan. 30, 1995, Pat. No. 5,626,423, which is a continuation-in-part of Ser. No. 294,495, Aug. 23, 1994, Pat. No. 5,385,402, which is a continuation of Ser. No. 175,726, Dec. 30, 1993, Pat. No. 5,340,213, which is a continuation of Ser. No. 939,424, Sep. 4, 1992, Pat. No. 5,275,487, which is a continuation of Ser. No. 622,104, Dec. 4, 1990, abandoned.

[51] Int. Cl.[6] ..... B01F 13/06

[52] U.S. Cl. ..... 366/348

[58] Field of Search ..... 366/64, 65, 102, 366/103, 104, 196, 261, 262, 263, 264, 61, 244, 245, 247, 249, 250, 251, 270, 292, 279, 297, 298, 299, 300, 301, 302, 343, 348, 285, 286, 603; 137/268

[56] References Cited

U.S. PATENT DOCUMENTS

| | | |
|---|---|---|
| 155,212 | 9/1874 | White . |
| 429,484 | 6/1890 | Schillinger . |
| 510,545 | 12/1893 | McLennan . |
| 539,288 | 5/1895 | McLennan . |
| 912,125 | 2/1909 | Hassam . |
| 1,192,478 | 7/1916 | Vanderlook . |
| 1,276,383 | 8/1918 | Ludekens . |
| 1,313,361 | 8/1919 | White . |
| 1,618,669 | 2/1927 | Morrell . |
| 1,652,960 | 12/1927 | Snelling . |
| 1,872,622 | 8/1932 | Donahue . |
| 1,893,451 | 1/1933 | Smith . |
| 1,896,616 | 2/1933 | Gilliclan . |
| 1,915,757 | 6/1933 | Pierce . |
| 1,981,010 | 11/1934 | Torson . |
| 2,052,544 | 9/1936 | Bartholomen . |
| 2,053,876 | 9/1936 | Pfau . |
| 2,081,850 | 5/1937 | Darby . |
| 2,081,851 | 5/1937 | Darby . |
| 2,081,852 | 5/1937 | Darby . |
| 2,108,416 | 2/1938 | Smith . |
| 2,128,873 | 8/1938 | Roberts . |
| 2,210,160 | 8/1940 | Beal . |
| 2,277,890 | 3/1942 | Steindorf . |

FOREIGN PATENT DOCUMENTS

| | | |
|---|---|---|
| 152558 | 7/1953 | Australia . |
| 637579 | 4/1962 | Italy . |
| 30-63313 | 5/1955 | Japan . |
| 0997775 | 2/1983 | U.S.S.R. . |
| 8164 | 8/1909 | United Kingdom . |
| 149585 | 8/1920 | United Kingdom . |
| 784525 | 10/1957 | United Kingdom . |
| 1214810 | 12/1970 | United Kingdom . |

*Primary Examiner*—Randall E. Chin
*Attorney, Agent, or Firm*—Finnegan, Henderson, Farabow, Garrett & Dunner, L.L.P.

[57] ABSTRACT

A method is disclosed for transportation and agitation of a substance having solid and liquid constituents. The method includes the steps of loading an intermodal pressure vessel onto an over-land intermodal carrier, the intermodal pressure vessel having a plurality of agitators located at therein, at least one of the plurality of agitators including an electric motor located entirely within the pressure vessel and being capable of operation within the pressure vessel when pressurized. The substance to be transported is conveyed into the intermodal pressure vessel which is then transported to a shipping port. At the shipping port, the intermodal pressure vessel is loaded from the over-land intermodal carrier onto a ship for overseas transportation. During transportation, at least some of the solids to settle and form a sediment on a floor portion of the intermodal pressure vessel. To resuspend the solids, an electric power source on at least one of the over-land carrier and the ship is connected to the electric motor to activate the motor and thereby cause the sediment to mix with the liquid.

1 Claim, 4 Drawing Sheets

INTERMODAL TRANSPORTATION OF SEDIMENTARY SUBSTANCES

CROSS-REFERENCE TO RELATED APPLICATIONS

This application is a continuation-in-part of application Ser. No. 08/378,799, filed Jan. 30, 1995 (now U.S. Pat. No. 5,626,423), which is a continuation-in-part of application Ser. No. 08/294,495, filed on Aug. 23, 1994 (now U.S. Pat. No. 5,385,402), which is a continuation of application Ser. No. 08/175,726, filed on Dec. 30, 1993 (now U.S. Pat. No. 5,340,213), which is a continuation of application Ser. No. 07/939,424, filed on Sep. 4, 1992 (now U.S. Pat. No. 5,275,487), which is a continuation of application Ser. No. 07/622,104, filed on Dec. 4, 1990 (now abandoned). Each of these disclosures is relied upon and incorporated herein by reference.

BACKGROUND OF THE INVENTION

1. Field of the Invention

The present invention relates to an apparatus and method for transporting and agitating a substance having solid and liquid constituents.

2. Description of Related Art

Many industrial processes require raw materials consisting of solid and liquid mixtures. For example mixtures, such as calcium carbonate in water or clay water slurries, are extremely difficult to transport and store because dense solid materials settle on the bottom of storage containers during transportation and/or storage. When the container is drained the liquid portion of the mixture is readily removed, but a portion of the solid sediment remains in the storage container. Thus it is difficult to completely unload all of the solid material.

Calcium carbonate is a substance used as a component in a number of common household medical products such as antacid and toothpaste. Additionally, the paper industry uses this material as a substitute for wood pulp paper filler to eliminate the need for unnecessary destruction of forestry. Because of the great demand for the end products produced by these industries, extremely large quantities of calcium carbonate must be transported.

Calcium carbonate is mined from the earth in large boulders, and crushed to create a fine powder substance. This powder is then normally mixed with water to create a solid and liquid suspension that is relatively easy to handle. The calcium carbonate and water mixture is loaded in transportation devices, such as railroad tank cars for shipping.

While the solid and liquid mixture is within the tank of a transportation device, the calcium carbonate solid material settles in the liquid and gradually forms a sediment on the bottom of the tank. This solid sediment is extremely difficult to remove from the tank when the tank is unloaded. The retention of solids in the bottom of the tank poses numerous disadvantages. First, the backhaul of the tank to pick up another load requires unnecessary rehauling of the solids back to the original pickup point, making the tank heavier and wasting fuel. Additionally, the build-up of solids reduces the capacity of the tank so that each subsequent refill of the tank includes less and less volume. Therefore it is desirous to remove all of the settled solid material along with the liquid when the mixture is unloaded. This removal process, however, is normally an extremely time consuming and expensive process.

Some previous attempts to deal with this problem have met with limited success. In one removal process a worker introduces a pressurized air hose through the opening of a tank and passes the open end of the hose along the bottom of the tank. The pressurized air circulates through the solid material to mix the solid with the liquid. This process is extremely inefficient, because a worker is required to pass the open end of the hose along the entire bottom surface of the tank in a time consuming procedure.

Additionally, sparger systems have been used on tank cars to recirculate a substance within a tank. These systems include a pipe positioned along the floor of a tank and having small holes along its length. This pipe is either connected to a source of compressed air or a fluid pump. When the product within the tank is nonflammable, the tank is vented and the compressed air is blown in the pipe to emit air bubbles from the holes for mixing the products in the tank. If a flammable product is within the tank, the material is recirculated in the tank by pumping liquid from the top of the tank into the pipe and allowing the liquid to flow through the holes into the bottom of the tank. These sparger systems have met with limited success, because settled solid material is not adequately mixed unless it is an extremely lightweight powder. Further, the small holes in the pipe are prone to clogging with solid material that has settled in the tank.

Because many of the current means for unloading solid and liquid mixtures are time consuming, large storage tanks having agitators are required at destination sites. These storage tanks maintain solid and liquid materials in a mixture form for immediate use in an industrial process, however, these on-site tanks could be eliminated if a solid and liquid mixture was able to be immediately unloaded from a transportation tank.

U.S. Pat. No. 1,652,960 to Snelling et al. discloses a tank for transporting materials along a railway. This tank has a series of rotatable agitating blades mounted to vertical shafts that extend through a top wall of the tank. These shafts are rotated by a horizontal drive shaft that is positioned on the tank exterior and connected to a belt pulley. Because the vertical shafts extend through a wall of the tank, complicated drive connections, bearings and seals are required. Additionally, it is often important to pressurize the vessel to facilitate unloading. However, because the shafts pass through the tank wall, it would be difficult if not impossible to comply certain Department of Transportation regulations as well as the American Society of Mechanical Engineers' pressure vessel standards.

SUMMARY OF THE INVENTION

Accordingly, the present invention is directed to an apparatus and method for transporting and agitating a substance having solid and liquid constituents that substantially obviates one or more of the limitations of the related art.

To achieve these and other advantages and in accordance with the purpose of the invention, as embodied and broadly described herein, the invention includes an apparatus and method for transporting and agitating a substance having solid and liquid constituents. The apparatus comprises a chassis having rotatable wheels, a pressure vessel mounted on the chassis and having at least one wall with an inner surface defining an interior space for containing the substance, the vessel having a ceiling, floor and an intermediate region between the ceiling and floor, a support located within the vessel interior space and mounted to the inner surface of the wall, a motor connected to the support and located entirely within the pressure vessel interior, the motor having a shaft positioned in a substantially vertical orientation and being operational in a pressurized environment, and an agitator blade located in the vessel interior and coupled to the shaft, the agitator blade being rotatable about a substantially vertical axis for directing the substance from the intermediate region toward the floor.

Preferably, the apparatus of the invention includes a plurality of motors located within the vessel interior at the intermediate region, each of the motors having a shaft and being mounted to a respective support, and each motor being capable of operation within a pressurized environment in a pressure vessel, and a plurality of agitator blades located in the vessel interior and spaced apart adjacent to the floor, each of the agitator blades being coupled to a respective shaft and being rotatable about a substantially vertical axis for directing the substance from the intermediate region toward the floor, the agitator blades being oriented so that when the blades are rotated substantially the entire floor is covered by rotating blades.

Additionally, the present invention includes a method of transporting a substance having solid and liquid constituents. The method comprises the steps of conveying a substance into a pressure vessel having a plurality of agitators located therein, each agitator including a motor, a substantially vertically oriented shaft, and a blade, the shaft having opposing ends entirely contained within the pressure vessel and the motor being located entirely within the pressure vessel and being capable of operation within the pressure vessel when pressurized, transporting the vessel to a destination and permitting at least some of the solids to settle and form a sediment on a floor portion of the pressure vessel, rotating the blades with the motors to drive liquid toward the floor to agitate the sediment and causing the sediment to mix with the liquid, thereby forming a substantially uniform mixture of solids and liquids in the pressure vessel, pressurizing the pressure vessel, and off-loading the substance by opening a port in the pressure vessel when the vessel is pressurized.

It is to be understood that both the foregoing general description and the following detailed description are exemplary, and are intended to provide further explanation of the invention as claimed. The accompanying drawings are included to provide a further understanding of the invention and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
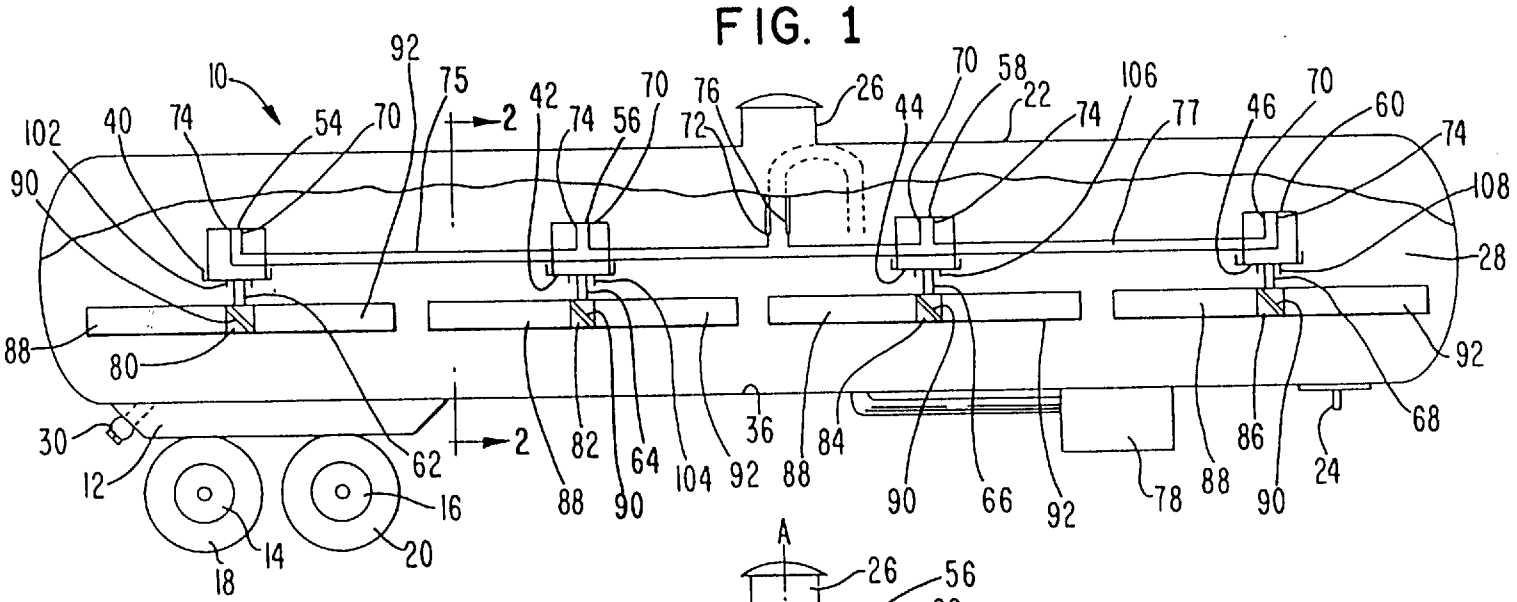
FIG. 1 illustrates a first embodiment of the invention wherein a wall of the pressure vessel is partially cut away to illustrate details of the vessel interior.

Reference will now be made in detail to the present preferred embodiments of the invention, examples of which are illustrated in the accompanying drawings. Wherever possible, the same reference numbers are used in the drawings and the description to refer to the same or like parts.

In accordance with the invention, there is provided an apparatus for transporting and agitating a substance having solid and liquid constituents the apparatus including a chassis having rotatable wheels. As embodied herein and as illustrated in FIG. 1, the apparatus may include a tanker trailer 10 having a chassis 12. The chassis 12 has rotatable wheels 14, 16 each having a tire 18, 20 respectively mounted thereon for transporting the apparatus 10 along a road surface. The chassis 12 also includes a pin 24 enabling the chassis 12 to be connected to a tractor or truck.

In accordance with the invention, a pressure vessel having a ceiling, intermediate region, floor and at least one wall is mounted on the chassis. As embodied herein and as shown in FIG. 1, the tanker trailer 10 includes pressure vessel 22 mounted on chassis 12. While vessel 22 is illustrated in the drawings as a straight tank, this illustration is not intended to limit the claim invention. Vessel 22 may be of any other shape including tanks referred to by one or more of the following terms: drop bottom, drop belly, double conical, or other commonly known or commercially available tankers. A manway collar 26 provides a resealable hatchway access into the interior 28 of the vessel 22, and a discharge 30 allows for removal of substances from the vessel 22. While FIG. 1 illustrates a rear discharge port, the invention, in its broadest sense is not so limited. Center, drop bottom, drop center, and other convention discharge port locations are also contemplated in accordance with the invention.

The pressure vessel 22 has a wall 32 surrounding the vessel interior 28 (see FIG. 2) to form an enclosed volume. The wall 32 defines a ceiling 34 at an uppermost region and a floor 36 at a lowermost region, while an intermediate region 38 is positioned therebetween. Preferably the vessel 22 may be constructed to meet the United States Department of Transportation's Standards for transportation of hazardous waste. Preferably the vessel 22 may be constructed as a pressure vessel conforming to the standards for pressure vessels established by the American Society of Mechanical Engineers. In a preferred embodiment of the invention the pressure vessel 22 is configured to operate with an internal working pressure of 10 pounds per square inch (psi) or greater to allow for off-loading of substances from the vessel by internal pressurization. Any passages through the vessel wall 32 must have sufficient seals to allow for this pressurization. Therefore other than for hydraulic lines 72, 76 passing through the manway collar 26 as described below, vessel wall 32 preferably contains no perforations, such as passages for rotating drive shafts.

Figure 2:
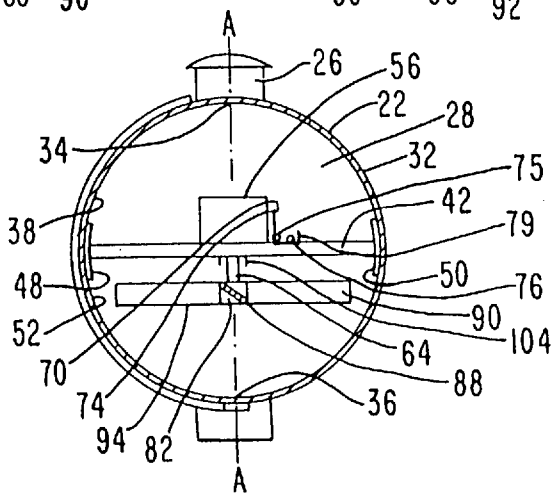
FIG. 2 is a cross-sectional view taken along line 2—2 of FIG. 1.

The vessel wall 32 is preferably fabricated from a non-corrosive material, such as 307 stainless steel or a material of similar or greater durability. As shown in FIGS. 1 and 2, the vessel wall 32 has a substantially circular cross section and forms a pressure vessel 22 having an elongated cylindrical shape. Preferably the length of the pressure vessel 22 is between 15 feet and 75 feet, while the cross sectional diameter is between 6 feet and 12 feet. The pressure vessel shape, and dimensions for the apparatus 10 shown in FIGS. 1 and 2 are merely illustrative of a preferred embodiment of the invention. Additional shapes, cross sections and dimensions for the pressure vessel 22 are envisioned. Further, the pressure vessel 22 could be formed from a plurality of walls (not shown) that have edges joined with welded seams.

Figure 5:
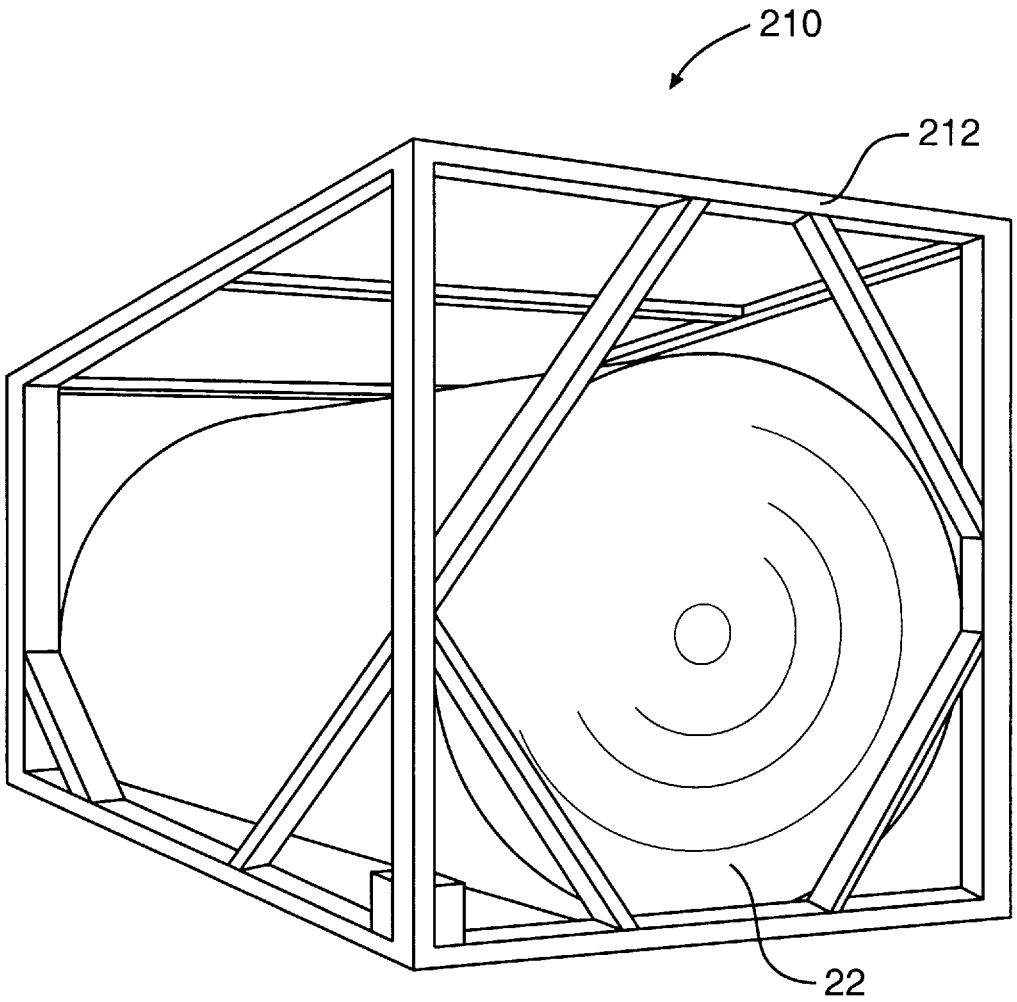
FIG. 5 illustrates an intermodal tank with which the invention may be used.

The pressure vessel 22 may be permanently mounted on chassis 12, as illustrated in FIG. 1. Alternatively, the pressure vessel 22 may be part of an intermodal tank unit. As illustrated in FIG. 5, intermodal tank unit 210 is a beam tank container, made up of a pressure vessel 22 surrounded by a beam frame 212. This structure permits the pressure vessel 22 to be selectively transported on a conventional over-land intermodal container carrier (i.e., road or rail) for over-land transportation, or alternatively transported on a container ship for overseas transportation.

In accordance with the invention a support is located within the pressure vessel and mounted to the inner surface of the vessel wall. As embodied herein and shown in FIGS. 1 and 2, the apparatus includes a plurality supports 40, 42, 44, 46 suspended within the interior 28 of the pressure vessel 22. In the preferred embodiment each of the supports 40, 42, 44, 46 is an elongated piece of channel steel having a U-shaped cross section. A hole (not shown) is arranged through the center of each of the supports 40, 42, 44, 46 for receiving substantially vertically oriented motor shafts 62, 64, 66, 68 as described below.

As depicted in FIG. 2, a pair of mounting pads 48, 50 at opposite ends of support 42 are welded to the interior surface 52 of the pressure vessel wall 32 in the intermediate region 38 and at a position approximately half way between the ceiling 34 and floor 36. This similar attachment structure is employed for each of the supports 40, 42, 44, 46. Each support 40, 42, 44 and 46 is completely contained within the interior space 28 and does not substantially obstruct fluid flow in the vessel 22.

In accordance with the invention, a motor having a substantially vertically oriented shaft is mounted to a support. As embodied herein and shown in FIG. 1, a plurality of motors 54, 56, 58, 60 are each respectively mounted on supports 40, 42, 44, and 46. Bolts (not shown) or other fastening means may be used for this mounting. Each of the motors 54, 56, 58, 60 is positioned approximately equidistant between the ceiling 34 and floor 36 at approximately the center of the cross section of the vessel 22, as shown in FIG. 2. Motors 54, 56, 58, 60 each have a rotatable shaft 62, 64, 66, 68 respectively extending through holes (not shown) in the center of supports 40, 42, 44, 46. The shafts 62, 64, 66, 68 assume a generally vertical orientation facing the floor 36. In a preferred embodiment bearings are not required between the shafts 62, 64, 66, 68 and the respective supports 40, 42, 44, 46, because each motor 54, 56, 58, 60 has internal bearings (not shown), such as those commonly found in wheel motors.

The motors 54, 56, 58, 60 and the shafts 62, 64, 66, 68 are contained entirely within the vessel interior 28 and are constructed so that they are capable of being operated within this pressurized environment. Motors capable of being operated while totally submerged are preferred. Additionally, because the pressure vessel 22 may frequently contain flammable substances, the motors 54, 56, 58, 60 are preferably non spark generating.

In a preferred embodiment, as shown in FIGS. 1 and 2, each of the motors 54, 56, 58, 60 is a hydraulic motor having a hydraulic fluid inlet 70 coupled to an inflow hydraulic fluid conduit 72 and a hydraulic fluid outlet 74 coupled to an outflow fluid conduit 76. The motors preferably contain VITON™ seals, known in the art. Such motors are commercially available under the trade name CHARLYNN™.

As shown in FIG. 1, the motors 54, 56 and motors 58, 60 are connected in series, the hydraulic fluid outlets 74 of motors 56, 58 being respectively interconnected with hydraulic fluid inlets 70 of motors 54, 60 by conduits 75, 77. This arrangement allows each of the motors 54, 56, 58, 60 to be energized with a single inflow hydraulic fluid conduit 72 and a single outflow hydraulic fluid conduit 76. When the hydraulic motors 54, 56, 58, 60 are connected in series as shown in FIG. 1, the intermediate motors 56, 58, may each have a k-strain line (not shown) connected to the outflow conduit 76 to reduce the hydraulic fluid pressure within the motor and prevent motor seal failure. The hydraulic fluid conduits 72, 76 pass through the manway collar 14 in a sealed fluid-tight fashion. This passage through the pressure vessel 22 does not compromise the integrity of the pressure vessel 22 for if external portions of conduits 72 or 76 were to shear, only hydraulic fluid would leak.

The hydraulic fluid conduits 72, 76 are coupled to a hydraulic fluid pump 78 in order to circulate the fluid through the conduits and energize the motors 54, 56, 58, 60. As shown in FIG. 1, the hydraulic fluid pump 78 may be mounted directly to the outside of the pressure vessel 22. Optionally, the fluid conduits 72, 76 may terminate outside of the vessel 22 at valved connectors (not shown) that are capable of being connected through flexible hoses and quick couplings to a hydraulic fluid pump completely separate from the vessel 22.

As shown in FIG. 2, a beam 79 having an L-shaped cross section may be arranged within the tank interior 28 on supports 40, 42, 44, 46 between each of the motors 54, 56, 58, 60 for supporting the hydraulic fluid conduits 72, 75, 76, 77 along the length of the pressure vessel 22. The hydraulic fluid conduits 72, 75, 76, 77 may be mounted to the beam 79 through the use of brackets or other mounting structures (not shown) to reduce conduit vibration and movement.

Although the preferred embodiment of FIG. 1 includes hydraulic motors, other types of motors may be appropriate for some applications. For example, air driven motors or submersible electric motors may be used within the pressure vessel 22. Intermodal over-land container carriers are typically outfitted with electric power sources, as are conventional overseas container ships. Thus, electric motors may be preferable, for example, when pressure vessel 22 is used in an intermodal configuration, such as is illustrated in FIG. 5.

Figure 3:
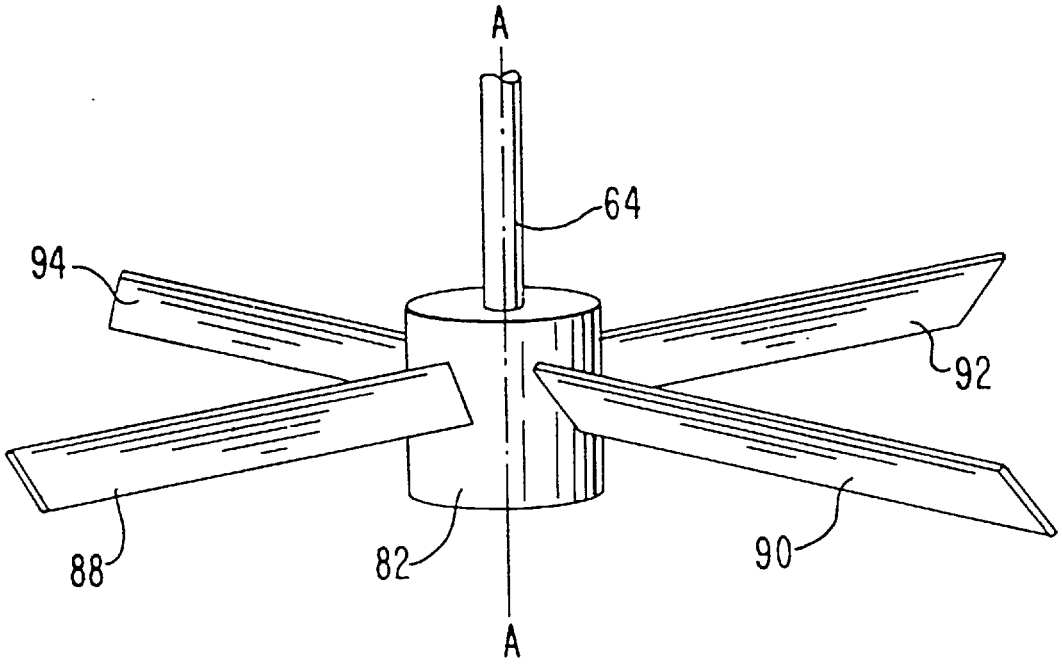
FIG. 3 is an oblique view of the agitator blades and hub shown in FIG. 2.

In accordance with the invention an agitator blade is coupled to the motor shaft for rotation about a substantially vertical axis and to direct substances toward the floor of the pressure vessel. As embodied herein and as best illustrated in FIG. 3 with reference to a single set of blades, hub 82 is mounted to the end of motor shaft 64. Four agitator blades 88, 90, 92, 94, are attached to hub 82. Each blade is oriented at a blade angle to a vertical axis A—A. This blade angle is preferably between 18° and 49°. In one embodiment of the invention used in connection with the transportation of calcium carbonate the blade angle is approximately 34°. Each of hubs 80, 84 and 86, have blades mounted in a manner similar to the blades of hub 82.

Each of the blades 88, 90, 92, 94 has a length between 6 inches and 4 feet and a width between 2 inches and 8 inches. Preferably the blades 88, 90, 92, 94 are spaced no greater than 14 inches below each respective motor 54, 56, 58, 60 to reduce the amount of torque and bending moment applied to each of the shafts 62, 64, 66, 68. A preferred distance from the bottom of each blade to the lowest portion of floor 36 is about 40 inches. Although a preferred embodiment includes four agitator blades (as shown in FIG. 3) connected to each hub, the number of blades may range in number from 1 to 10 with a preferred range being between 4 and 10.

When the motors 54, 56, 58, 60 are energized the blades 88, 90, 92, 94 rotate about a substantially vertical axis A—A. The rotating blades direct substances within the pressure vessel 22 from the intermediate region 38 toward the floor 36 to agitate the substance. Liquid above the blades 88, 90, 92, 94 is driven toward the floor 36 to mix with solid particle constituents formed into sediment on the floor 36. After the liquid is driven toward the floor 36, the solid and liquid mixture is forced along the interior surface 52 of the pressure vessel 22 toward the ceiling 34. Thus, all of the substance contained within the pressure vessel 22 is effectively blended to eliminate or significantly reduce the sediment on the floor 36.

When each set of blades is rotated the rotational blade paths should cover a minimum of 15% of the floor. Preferably, the rotational blade paths cover substantially the entire floor 36 so that all of the floor area is subjected to the force of a rotating blade. Tips of adjacent blades are preferably spaced apart by between 2 inches and 20 inches. Preferably when each blade rotates a tip end of one rotating blade is no more than 48 inches from the tip end of an adjacent rotating blade. Additionally, when the blades rotate, their tips are spaced by no more than about 32 inches from the interior wall surface 52. In a preferred embodiment the blade tip to wall spacing is 10 inches.

As depicted in FIGS. 1 and 2, sleeves 102, 104, 106, 108 surround each shaft 62, 64, 66, 68 respectively to prevent solids from damaging the motor seals. The sleeves 102, 104, 106, 108 are connected respectively at one end in a sealed fashion to motors 54, 56, 58, 60, although they may be alternatively sealingly connected to supports 40, 42, 44, 46. An open opposite end of each sleeve 102, 104, 106, 108 is positioned adjacent to the blades 88, 90, 92, 94. Each sleeve thereby forms a chamber around each of the shafts 62, 64, 66, 68. The sleeves 102, 104, 106, 108 trap a pocket of air around each of the shafts 62, 64, 66, 68 when the pressure vessel contains a substance. This trapped pocket of air inhibits substance from passing around each shaft 62, 64, 66, 68 and into each motor 54, 56, 58, 60.

In accordance with the invention the apparatus may include a railcar chassis for transportation along railroad tracks. As illustrated in a second embodiment of the invention in FIG. 4, an apparatus 100 includes railcar chassis 112, 113 having rotatable railcar wheels 114, 115 and 116, 117 for transporting the apparatus along railroad tracks. A pressure vessel 122 mounted on the chassis 112, 113 has supports 142, 144, 146, 148, motors 154, 156, 158, 160, shafts 162, 164, 166, 168 agitator blades 188, 190, 192, hydraulic inflow conduit 172, hydraulic outflow conduit 176 and hydraulic fluid pump 178 configured as in the embodiment of FIG. 1. The arrangement of motors, supports, shafts, and blades is similar to that disclosed in connection with FIGS. 1–3.

In accordance with the invention, there is also provided a method of transporting a substance having solid and liquid constituents wherein a substance is conveyed into a pressure vessel having a plurality of agitators. This method is explained below with reference to the embodiments described above. However, it should be understood that the method of the invention is not limited to the structure disclosed herein.

A substance, for example calcium carbonate in water, having solid and liquid particles is conveyed into the pressure vessel 22 through the manway collar 26. The amount of substance conveyed into the pressure vessel 22 may be sufficient to partially or completely submerge each of the motors 54, 56, 58, 60. As the level of substance rises above the level of the opening in each sleeve 102, 104, 106, 108 a pocket of air is trapped around each of the motor shafts 62, 64, 66, 68. This air trapped around the motor shafts 62, 64, 66, 68 inhibits the passage of the substance into each of the motors.

Figure 4:
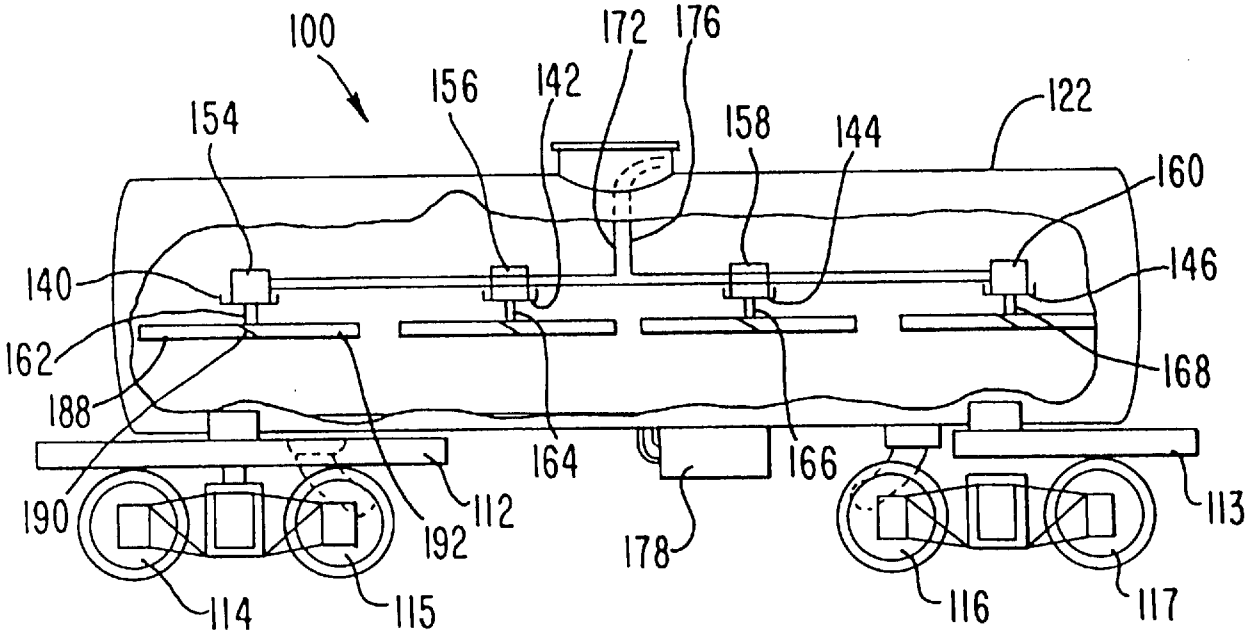
FIG. 4 illustrates a second embodiment of the invention wherein a wall of the pressure vessel is partially cut away to illustrate details of the vessel interior.

In accordance with the present invention a pressure vessel is transported to a destination while at least some of the solids settle and form sediment. The pressure vessel 22 depicted in FIG. 1 is transported to a destination along a road surface by hauling the apparatus 10 with a truck or other power vehicle coupled to pin 24. Alternatively, railcar chassis 113, 114, as shown in the embodiment of FIG. 4, may be used to transport the pressure vessel 122 to a destination along railroad tracks. An intermodal configuration, such as is depicted in FIG. 5, may be used for transportation over a combination of road, rail, and sea. The motors 54, 56, 58, 60 are not activated to rotate the blades 88, 90, 92, 94 during at least a portion of the transportation process. Therefore, solid particles within the pressure vessel 22 settle to the floor 26 and form a sediment. This sediment can remain indefinitely within the pressure vessel, because the blades 88, 90, 92, 94 are positioned above the floor 36 at a position that is above a normal sediment level.

When the pressure vessel 22 is transported to a desired destination the solid sediment on the floor 36 must be resuspended in the liquid to facilitate unloading of the pressure vessel 22. To resuspend the solid sediment, each of the motors 54, 56, 58, 60 is energized by a power source positioned exterior of the pressure vessel. With the embodiment of FIG. 1 for example, this step is accomplished by activating the hydraulic fluid pump 78 located on the exterior of the pressure vessel 22. Alternatively, this step may be accomplished by connecting the inflow and outflow hydraulic fluid lines 72, 76 through flexible hoses and quick couplings (not shown) to a hydraulic fluid pump (not shown) completely separate from the vessel 22.

If the power source is a hydraulic fluid pump such as pump 78, hydraulic fluid is circulated as follows: initially the hydraulic fluid is pumped through hydraulic fluid inflow conduit 72 into the hydraulic fluid inlets 70 on motors 56, 58; hydraulic fluid then flows from outlets 74 of motors 56, 58 through conduits 75, 77 and into inlets 70 of motors 54, 60; thereafter the hydraulic fluid flow from the outlets 74 on motors 54, 60 and into outflow conduit to return to the hydraulic fluid pump 78.

The blades 88, 90, 92, 94 attached to each of the hubs 80, 82, 84, 86 are rotated about a substantially vertical axis of rotation A—A when the motors 54, 56, 58, 60 rotate the respective shafts 62, 64, 66, 68. The blades 88, 90, 92, 94 rotate in an appropriate rotational direction to direct the substance within the pressure vessel 22 toward the floor 36. In a preferred embodiment this blade rotation is at a rate of less than 250 RPM, with a preferred rate being approximately 75 RPM. Because the blades 88, 90, 92, 94 are relatively long and wide with respect to the size of pressure vessel 22, these low rotational speeds are possible. Thus, vibration and noise are reduced. Additionally, cavitation does not take place around the blades, enabling flammable substances to be agitated without the risk of explosion due to excessive aeration.

Initially when the blades 88, 90, 92, 94 are rotated, liquid and any light solids within the pressure vessel 22 is driven towards the floor 36. The liquid gradually peels off layers of solid particles from the sediment on the floor 36 to create a solid and liquid mixture that is forced upwards in the pressure vessel 22 by flowing up the interior wall surface 52. Thereafter the rotating blades 88, 90, 92, 94 direct the mixture towards the floor 36. All of the substance within the pressure vessel 22 is recirculated in this fashion at least once during a six minute interval. Because the supports 40, 42, 44, 46 occupy a very small percentage of the total volume of the pressure vessel 22, they do not interfere with flow in the pressure vessel 22. The blade rotation is continued until all of the solid particles are removed from the floor 36 to create a homogeneous, substantially uniform, solid and liquid mixture.

When a uniform mixture of solids and liquids is attained within the pressure vessel 22, the substance is offloaded from the pressure vessel 22. offloading preferable is accomplished using pressure. To this end, pressure vessel 22 is connected to a suitable pressurizing apparatus. Next, a port, such as discharge 30, is opened so that pressure in vessel 22 forces the mixture out of vessel 22. Effectively all of the solid particles within the pressure vessel 22 are removed along with the liquid in the practice of this invention.

If an intermodal configuration is used, depending on the contents of the pressure vessel 22, it may be beneficial to periodically agitate the vessel contents, especially if shipping occurs over an extended time period. To this end, use of at least one electric motor is helpful because conventional intermodal over-land container carriers are equipped with electrical power sources. Likewise, conventional container ships are similarly equipped. Therefore, during intermodal transportation, the contents of pressure vessel 22 can be agitated periodically, if desired, utilizing an existing electric power source on the vehicle itself. To limit wear, tear, and energy consumption, a timer may be provided for the electric motor(s) to periodically agitate the contents of the vessel. Of course, optimum frequency and duration of timed agitation depends on the vessel's contents.

In overseas use, sedimentary substances are first conveyed into the intermodal tank unit 210 at a tank filling location and transported over land to a shipping port by either a conventional road or rail intermodal container carrier. If desired, the agitation system may be activated during land transportation using the intermodal container carrier's own electric power source. After arriving at the shipping port, intermodal tank unit 210 is then loaded onto a container ship using conventional loading machinery. Once loaded on the ship, the electric motor(s) of the intermodal tank unit 210 may be electrically connected (plugged in) to an electrical power source located on the ship itself so that the agitation system may be activated during overseas shipping. Agitation may occur for the duration of overseas shipping or periodically depending on whether a timer is employed, as previously discussed. When the ship reaches its destination, the power source is disconnected from the intermodal tank unit 210, and unit 210 is then loaded on an over-land intermodal container carrier for transportation to a final unloading destination. During this final leg of the trip, the agitation system may be used, if desired, as previously discussed. Once at the unloading destination, the contents of pressure vessel 22 may be emptied in a manner discussed previously in connection with FIG. 1.

It will be apparent to those skilled in the art that various modifications and variations can be made to the structure and methodology of the present invention without departing from the scope or spirit of the invention. In view of the foregoing, it is intended that the present invention cover modifications and variations of this invention provided they fall within the scope of the following claims and their equivalents.

What is claimed is:

1. An intermodal method of transporting a substance having solid and liquid constituents, the method comprising the steps of:

loading an intermodal pressure vessel onto an over-land intermodal carrier, the intermodal pressure vessel having a plurality of agitators located at therein, at least one of said plurality of agitators including an electric motor located entirely within the pressure vessel and being capable of operation within the pressure vessel when pressurized;

conveying the substance into the intermodal pressure vessel;

transporting via over-land intermodal carrier the intermodal pressure vessel to a shipping port;

loading the intermodal pressure vessel from the over-land intermodal carrier onto a ship for overseas transportation;

permitting, during transportation, at least some of the solids to settle and form a sediment on a floor portion of the intermodal pressure vessel;

activating said at least one electric motor, using an electric power source on at least one of the over-land carrier and the ship, to thereby cause the sediment to mix with the liquid.

* * * * *